United States Patent [19]

Graf

[11] 4,342,890

[45] Aug. 3, 1982

[54] GAS-BLAST SWITCH

[75] Inventor: Rudolf Graf, Obermuhen, Switzerland

[73] Assignee: Sprecher & Schuh AG, Aarau, Switzerland

[21] Appl. No.: 120,392

[22] Filed: Feb. 11, 1980

[30] Foreign Application Priority Data

Apr. 24, 1979 [CH] Switzerland ..... 3834/79

[51] Int. Cl.[3] ..... H01H 33/88

[52] U.S. Cl. ..... 200/148 A; 200/148 R

[58] Field of Search ..... 200/148 A, 150 G

[56] References Cited

U.S. PATENT DOCUMENTS

| | | | |
|---|---|---|---|
| 3,941,962 | 3/1976 | Thaler | 200/148 A |
| 4,112,276 | 9/1978 | Cromer et al. | 200/148 A |
| 4,139,753 | 2/1979 | Cromer et al. | 200/148 A |

*Primary Examiner*—Robert S. Macon

*Attorney, Agent, or Firm*—Werner W. Kleeman

[57] ABSTRACT

A gas-blast switch containing a stationary and a movable contact element. A blast nozzle associated with one of the contact elements possesses a blast channel, which during the course of the cut-off stroke, is freed from the other contact element. Additionally, there is provided a blast-in opening, transversely arranged with respect to the extinguishing path and opening into the blast channel. The blast-in opening has a flow cross-section which is appreciably smaller than that of the blast channel. Both the blast channel and the blast-in opening flow communicate with a pump compartment containing an extinguishing gas and which can be pressurized by the cut-off stroke of the switch. To impart an increasingly greater velocity to the gas outflowing from the blast-in opening during the cut-off stroke, and thus, to realize a more effective flow-through or turbulent movement of the extinguishing gas at the extinguishing path at the region of the blast channel, the pump compartment is divided into two pump chambers, separated from one another at the latest during the cut-off stroke. The one pump chamber feeds the blast channel, the other pump chamber the blast-in opening. Since such possesses the smaller flow-cross section the pressure increase in the other pump chamber, during the cut-off stroke, is greater, and thus, there also is increased the flow velocity of the extinguishing gas flowing out of the blast-in opening.

5 Claims, 2 Drawing Figures

GAS-BLAST SWITCH

BACKGROUND OF THE INVENTION

The present invention relates to a new and improved construction of gas-blast switch.

Generally speaking, the gas-blast switch of the present invention is of the type comprising a stationary contact element and a movable contact element. A blast nozzle is operatively associated with one of these contact elements. The blast nozzle has a blast channel which is freed, during the course of a cut-off stroke of the gas-blast switch, from the other contact element. At least one blast or blow-in opening is arranged transversely with respect to the extinguishing path and opens into the blast channel. The flow cross-sectional area of the blast or blow-in opening is less than that of the blast channel. Both the blast channel and also the blow-in opening are connected with a pump compartment containing an extinguishing gas which can be pressurized during the cut-off stroke.

Such gas blast switches are known, for instance, from U.S. Pat. No. 3,946,180, Swiss Pat. No. 522,284, particularly FIGS. 3 and 4, and German Pat. publication No. 2,710,868. The extinguishing gas-main stream formed in the blast channel during the course of a cut-off stroke of the gas-blast switch, is additionally placed into a turbulent flow by the extinguishing gas flowing out of the blow-in or blast-in opening, thereby improving the extinguishing characteristics of the gas-blast switch.

In any event, however, with the heretofore known gas-blast switches of the previously mentioned type this additional turbulence of the extinguishing gas flow is quite modest, because both the blast channel and also the blow-in opening are connected with one and the same pump chamber. The extinguishing gas located in the pump chamber, during the course of the cut-off stroke, is compressed. As soon as the blast channel frees the blast nozzle from the other contact element, the extinguishing gas flows out of the pump chamber especially through the blast channel itself. The amount of compressed extinguishing gas, flowing out of the blow-in opening, is comparatively small due to its smaller through-flow cross-sectional area and the velocity, with which this part of the extinguishing gas flows out of the blow-in openings, is only slightly greater than the flow velocity in the blast channel, because both the blast channel and also the blow-in openings so-to-speak "deplete" or "exhaust" compressed extinguishing gas out of the same gas supply.

SUMMARY OF THE INVENTION

Therefore, with the foregoing in mind it is a primary object of the present invention to provide a new and improved construction of gas-blast switch of the previously mentioned type, wherein the extinguishing gas, flowing out of the blast-in opening, during the course of the cut-off stroke of the gas blast switch, experiences a greater compression than the extinguishing gas flowing to the blast channel.

A further object of the invention is to provide a gas-blast switch which is constructed such that the exit velocity of the extinguishing gas from the blow-in or blast-in opening is appreciably increased, so that the gas jets formed transversely with respect to the main flow direction in the blast channel work more effectively against the plasma pressure of the burning switching arc, and thus, produce a more effective turbulence or flow condition, which beneficially causes extinguishing of the arc at the earliest point in time.

Yet a further important object of the present invention is to provide a new and improved construction of gas-blast switch of the previously mentioned type which is relatively simple in construction and design, economical to manufacture, extremely reliable in operation, not readily subject to breakdown or malfunction, requires a minimum of maintenance and servicing and ensures for positive and early extinguishing of the arc.

Now in order to implement these and still further objects of the invention which will become more readily apparent as the description proceeds, the gas-blast switch of the invention is manifested by the features that the pump compartment is subdivided into two pump chambers which are separated from one another at the latest during the course of the cut-off stroke of the gas-blast switch, and the blast channel flow communicates with the one pump chamber and the blow-in opening with the other pump chamber.

By dividing the pump compartment into two pump chambers separated from one another, the course or development of the pressure increase, during the cut-off stroke for each of the pump chambers, is not only dependent upon the path of the cut-off stroke but also upon the "outlet cross-section" of each of the pump chambers. Since the flow cross-section of the blast channel is greater than that of the blow-in or blast-in opening, the effective pressure increase in the pump chamber supplying the blast channel is less than in the pump chamber which feeds the blow-in opening.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
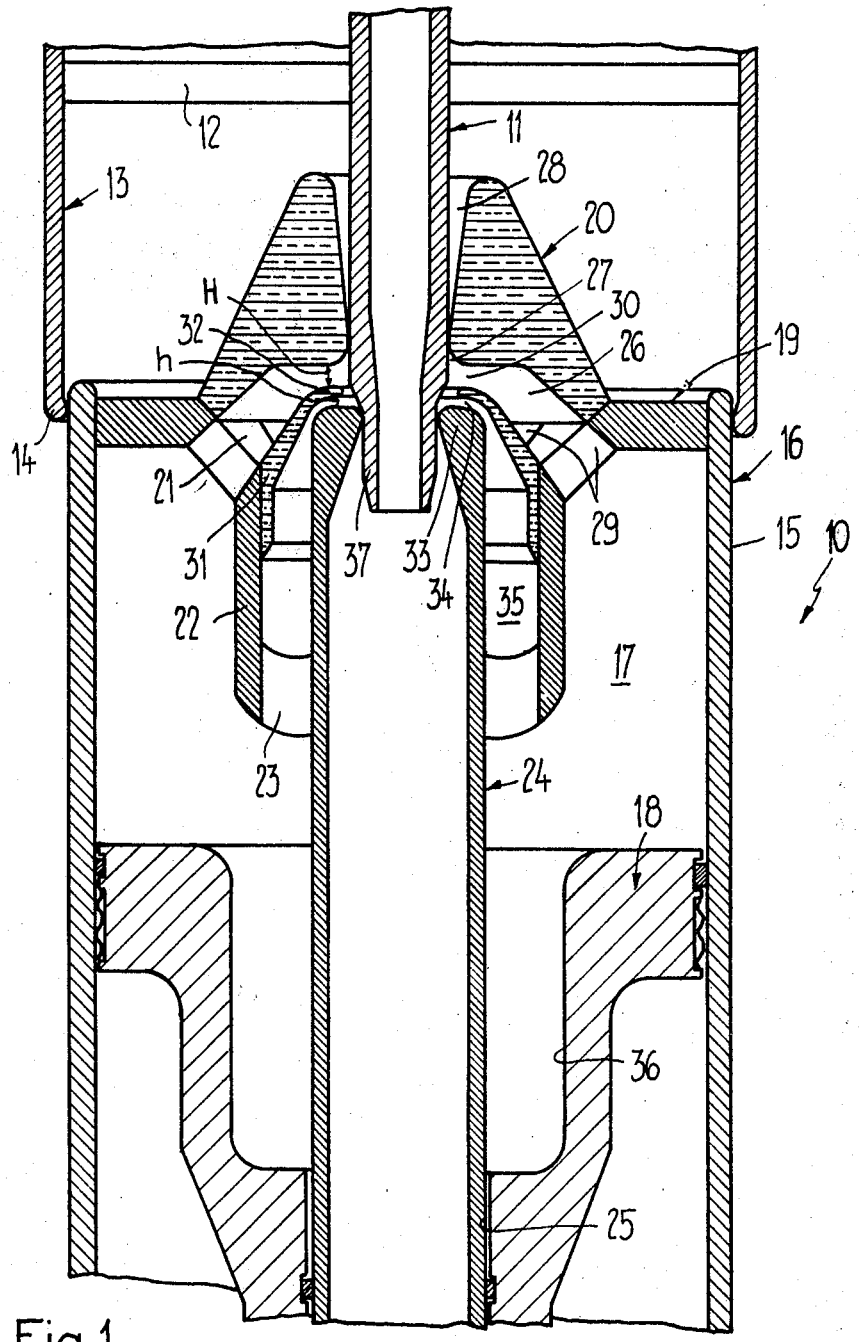
FIG. 1 is a schematic axial sectional view through a gas-blast switch in its cut-on position showing the more important components or parts thereof and constructed according to the teachings of the present invention.

Describing now the drawings it is to be understood that only enough of the structure of the gas-blast switch has been shown, to simplify the illustration, while enabling those skilled in the art to readily understand the underlying principles and concepts of the present invention. With the illustrated exemplary embodiment of gas-blast switch 10 there will be seen that there is provided a stationary or fixed, substantially tubular-shaped arcing contact element 11, which is centered by ray-like or radially arranged webs or struts 12 or equivalent structure and is surrounded by a likewise stationary contact tube 13. In the cut-on position of the gas-blast switch this contact tube 13 serves to conduct the predominant part of the rated current flowing through the gas-blast switch, and therefore, for this purpose is in engagement with, by means of its lower edge 14, the jacket surface 15 of a movable contact cylinder 16. This contact cylinder 16 surrounds a pump compartment 17 containing an extinguishing gas typically for instance $SF_6$. At one end this pump compartment 17 is bounded by a stationarily supported pump piston 18, at its other end it is bounded by a flange 19 attached to the contact cylinder 16 at the upper end thereof.

On the one hand, there is secured to the flange 19 a blast nozzle 20, on the other hand by means of struts 21 there is attached a substantially tubular-shaped partition wall 22. The partition or separation wall 22 is arranged coaxially with respect to the contact cylinder 16 and extends in the direction of the pump piston 18. The lower end of the partition wall 22 is connected by means of struts 23 or equivalent structure at a tubular-shaped arcing contact element 24. This contact element 24 is movable in conjunction with the contact cylinder 16, the blast nozzle 20 and the partition wall 22. Furthermore, the contact element or member 24 sealingly penetrates through a bore 25 provided in the pump piston 18. The contact element 24 and the contact cylinder 16 are coupled with a not particularly illustrated but conventional drive and therefore move conjointly during the cut-on and cut-off strokes of the gas-blast switch.

The blast nozzle 20 encloses a blast channel which, viewed in the flow direction, is composed of a converging inlet section or portion 26, a narrow portion or throat 27 and a diffuser-like diverging outlet section or portion 28. The inlet portion or section 26 is connected by means of the continuously free passages or openings 29, arranged between the struts 21, with the pump compartment 17 and its flow cross-sectional area reduces towards the throat 27 up to a substantially ring-shaped flow-in channel 30 having the height H.

At the region of the upper end of the partition wall 22 there is attached at its inner surface a hollow partition body 31 which, like the blast nozzle 20, is fabricated from a suitable electrical insulating material. This partition body 31 essentially has the shape of a truncated cone and engages by means of its upper, inwardly flexed edge 32 over the free end 33 of the movable contact element 24 while leaving free a radially inwardly open annular or ring-shaped gap 34 having a height h. The height h of the ring-shaped gap 34 is appreciably smaller than the height H of the inflow channel 30, so that also the flow cross-sectional area of the ring-shaped gap 34 is appreciably less than that of the inflow channel 30. The ring-shaped gap 34 forming the blow-in opening, in the cut-on position of the gas blast switch, flow communicates with the pump compartment 17 by means of the chamber 35 surrounded by the partition wall 22.

At the side of the pump piston 18, confronting the pump compartment 17, there is formed a cylindrical recess 36, the diameter and height of which essentially corresponds to the external diameter and the length, respectively of the partition wall 22.

In the cut-on position the contact element 11 retains by means of its external diameter or surface, the blast nozzle 20 closed at its throat 27 and by means of its stepped free end 37, reduced to a smaller external diameter, it also maintains closed the movable contact element 24. The still undivided pump compartment 17 is therefore completely closed in itself.

Figure 2:
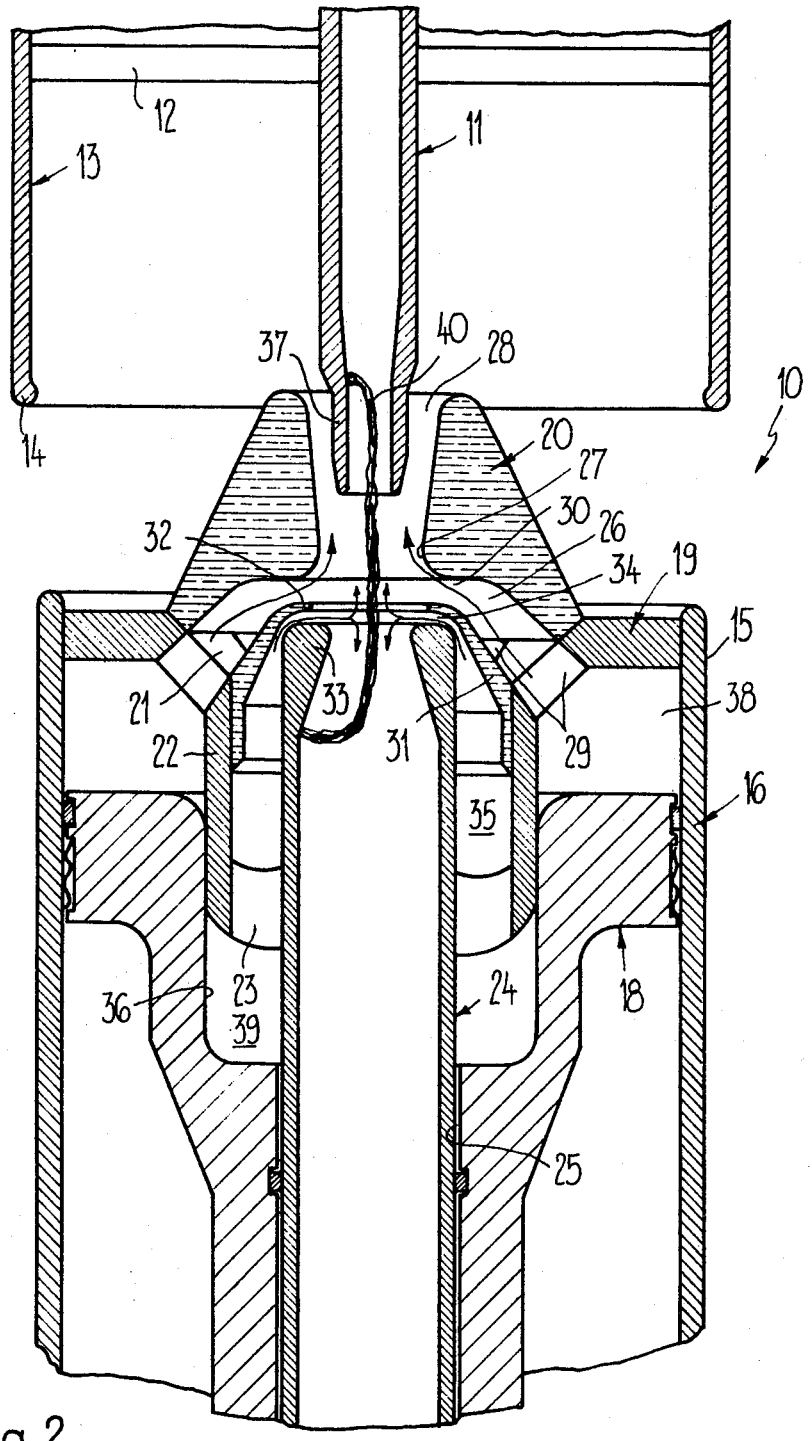
FIG. 2 is a view, like the showing of FIG. 1 but showing the parts of the gas-blast switch thereof in their position during the cut-off stroke.

Referring now to FIG. 2 there will be described the operations which occur during a cut-off movement of the gas-blast switch. As already mentioned, during the cut-off stroke the contact cylinder 16, the flange 19 together with the blast nozzle 20 and the partition wall 22 as well as the movable contact element 24 are downwardly displaced, whereas the contact tube 13, the contact element 11 and the pump piston 18 are stationarily arranged.

Initially, the contact cylinder 16 comes out of engagement with the contact tube 13. Between both of these elements there does not yet ignite any arc, since the entire current now flows over the contact elements 11 and 24 which are in engagement with one another. The extinguishing gas contained within the pump compartment 17 is precompressed. If the contact element 24 with its free end 33 departs from the free end 37 of the contact element 11, then a switching arc 40 ignites between both such free ends 33 and 37. As soon as the throat 27 of the blast nozzle 20 departs from the free end 37 of the contact element 11, and thus, is freed, there is initiated blowing of the switching arc. At the same time however the partition wall 22 engages into the recess 36 and thus subdivides the pump compartment 17 into two mutually separated pump chambers 38 and 39. The outer one of such pump chambers, namely the pump chamber 38 of FIG. 2, located between the inner surface of the contact cylinder 16 and the outer surface of the partition wall 22 only feeds the inflow channel 30. The inner pump chamber, namely the pump chamber 39 of FIG. 2 formed by the compartment or chamber 35 and the volume of the recess 36 which reduces during the course of the cut-off stroke, only supplies the annular or ring-shaped gap 34.

Since a lesser quantity of extinguishing gas is capable of flowing out of the pump chamber 39 through the ring-shaped gap 34 than out of the pump chamber 38, the pressure in the pump chamber 39 increases more markedly, during the cut-off stroke, than in the pump chamber 38. Consequently, the outflow velocity of the gas from the ring-shaped gap 34 increases quite appreciably, which, first of all, causes a pronounced turbulence of the gas flow flowing out of the inflow channel 30 in the direction of the outflow portion or section 28 and, secondly, drives the base of the arc 40 extensively into the continuous or open-end tubular-shaped constructed movable contact element 24.

In other words there is formed at the extinguishing path, at the height of the ring-shaped gap 34, a dam-up pressure peak which is effective over a small axial length, causing a rapid and positive extinguishing of the switching arc 40.

With the described gas-blast switch the subdivision of the pump compartment 17 into both of the pump chambers 38 and 39 is carried out first during the course of the cut-off stroke. However, it is also possible to provide two continuously separate pump chambers, and specifically, by resorting to the following design: An inner pump piston is engaged with play by an external, ring-shaped pump piston. In the play between both pump pistons there displaceably engages but sealingly the partition wall which is co-movable along with the movable contact element.

Additionally, the ring-shaped gap 34, possibly replaced by a rim of blow-in or blast-in openings, also can be arranged following the inflow channel 30, for instance at the height of the throat 27. In this case the inner pump chamber would supply the inflow channel and the outer pump chamber would supply the blow-in openings.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A gas-blast switch comprising:

a fixed arcing contact element;

a movable arcing contact element cooperating with said fixed arcing contact element;

said arcing contact elements defining between each other an arcing path during the course of a cut-off stroke;

one of the arcing contact elements having a free end;

a blast nozzle operatively associated with said one arcing contact element;

said blast nozzle comprising a blast channel having a throat disposed at a distance from the free end of said one associated arcing contact element and surrounding said arcing path;

said blast nozzle further comprising a blow-in opening arranged between said free end and the throat of the blast channel and opening transversely with respect to said arcing path into said blast channel;

said blow-in opening having a through-flow cross-sectional area which is less than the through-flow cross-sectional area of the blast channel;

means defining a pump compartment containing an extinguishing gas and capable of being pressurized during the cut-off stroke of the gas blast switch;

both the blast channel and the blow-in opening being connected with said pump compartment;

means subdividing the pump compartment into pump chambers which are separate from one another at the latest during the course of the cut-off stroke; and said blast channel flow communicating with one of the pump chambers and the blow-in opening with the other pump chamber.

2. The gas-blast switch as defined in claim 1, wherein:

said blow-in opening is located immediately following and downstream of said free end of said one arcing contact element with respect to the direction of gas flow from said pump compartment.

3. The gas-blast switch as defined in claim 1, wherein:

said means defining said pump compartment comprises a piston limiting one end of the pump compartment;

said piston having a face confronting the pump compartment which is provided with recess means;

said recess means belonging to the pump chamber associated with the blow-in opening;

said means defining said blow-in opening comprising a substantially tubular-shaped partition wall connected with the movable contact element; and said partition wall engaging into said recess means during the course of the cut-off stroke and separating the pump chamber associated with the blow-in opening from the pump chamber associated with the blast nozzle and which surrounds the partition wall.

4. The gas-blast switch as defined in claim 1, wherein:

the pump chamber associated with the blast channel possesses a greater volume than the pump chamber associated with the blow-in opening at the point in time of separation of both pump chambers from one another.

5. The gas-blast switch as defined in claim 1, wherein:

the one pump chamber surrounds the other pump chamber and is separated therefrom by a substantially tubular-shaped partition wall constituting at least part of said means defining said blow-in opening.

* * * * *